United States Patent [19]

Moskowitz

[11] 4,033,516

[45] July 5, 1977

[54] GRINDING APPARATUS AND METHOD

[75] Inventor: Paul M. Moskowitz, Brooklyn, N.Y.

[73] Assignee: Salton, Inc., Bronx, N.Y.

[22] Filed: June 9, 1976

[21] Appl. No.: 694,176

[52] U.S. Cl. ..... 241/30; 241/248

[51] Int. Cl.[2] ..... B02C 7/11

[58] Field of Search ..... 241/27, 30, 245, 246, 241/248, 249

[56] References Cited

UNITED STATES PATENTS

| | | | |
|---|---|---|---|
| 678,111 | 7/1901 | Adelsperger | 241/248 |
| 811,945 | 2/1906 | McLaughlin | 241/248 |
| 1,985,606 | 12/1934 | Herrmann | 241/248 |
| 2,663,340 | 12/1953 | Goodwin | 241/246 |
| 2,763,440 | 9/1956 | Johnson | 241/248 |

*Primary Examiner*—Granville Y. Custer, Jr.
*Attorney, Agent, or Firm*—Edward D. O'Brian

[57] ABSTRACT

The movement of material being ground and/or to be ground within a grinding apparatus having opposed grinding wheels can be employed in order to promote the flow of the material to generally between the grinding wheels. A grinding apparatus to utilize such movement for this purpose has in addition to the grinding wheels a structure for causing relative rotation between the wheels, an inlet opening leading through the center of one of the wheels to generally between the wheels, and a hopper for conveying material through this opening to generally between the wheels. In addition, such an apparatus includes a shaft rotatably mounted on a bearing between the hopper and a finger or agitator extending from the shaft generally toward and preferably to within the opening in the grinding wheel, at least a portion of this finger or agitator being spaced from the axis of the shaft. As the apparatus is operated movement of the material caused by the relative rotation between the grinding wheels will cause movement of the finger or agitator so as to promote flow from the hopper to between the grinding wheels.

12 Claims, 5 Drawing Figures

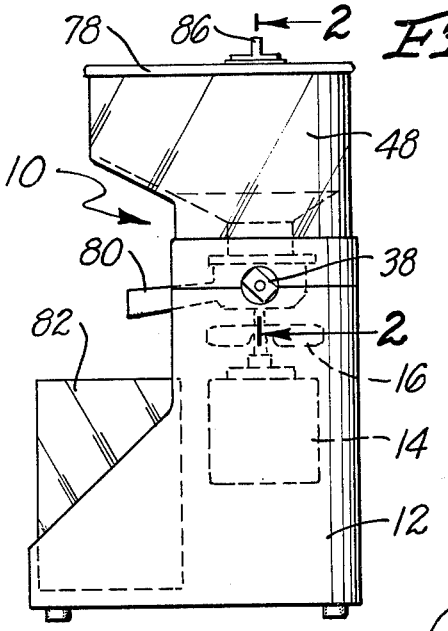
FIG. 1.
FIG. 2.
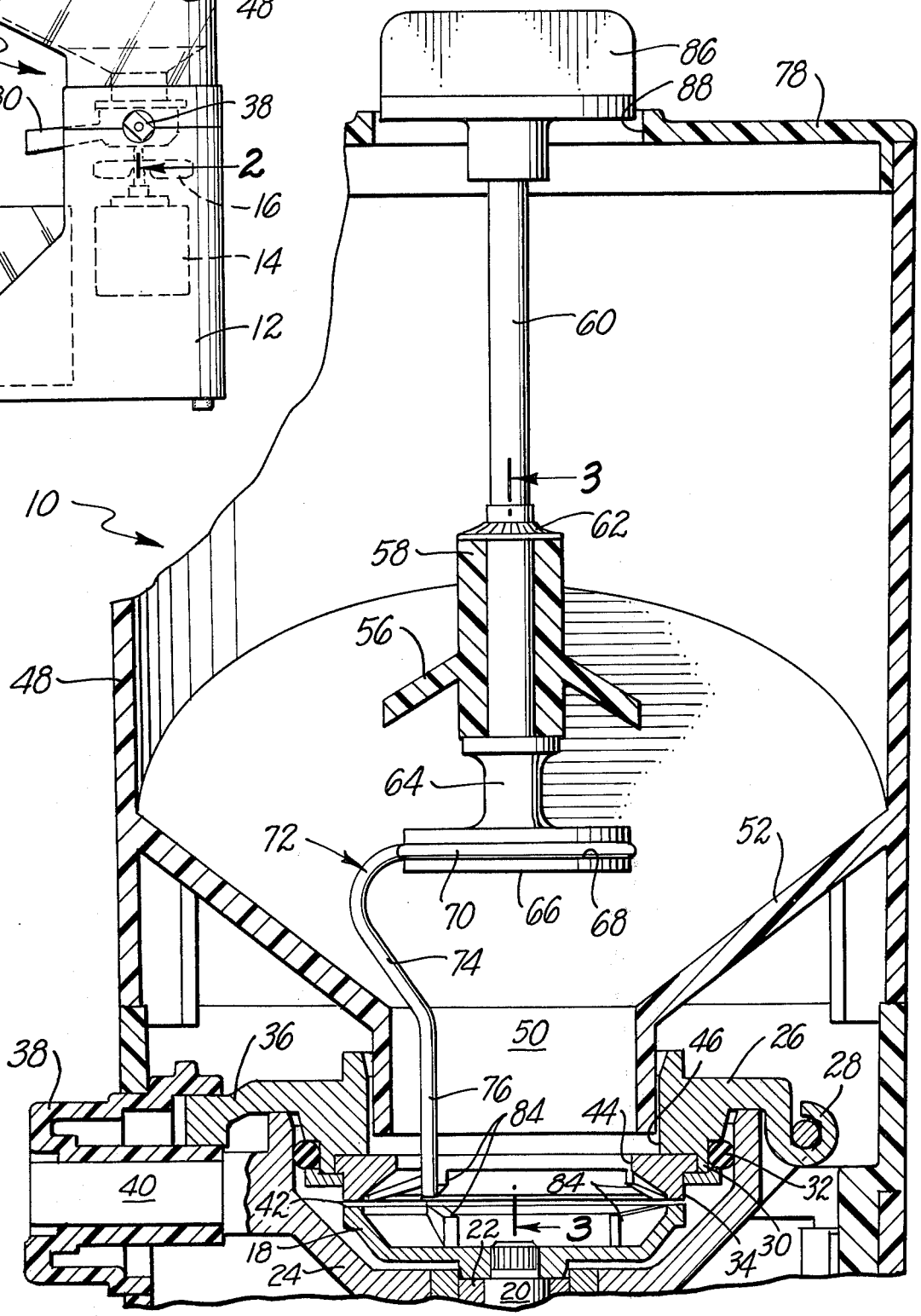

GRINDING APPARATUS AND METHOD

CROSS-REFERENCE TO RELATED APPLICATIONS

Portions of the disclosure of this application pertain to subject matter disclosed and claimed in the Brown, et al. application Ser. No. 585,379, entitled "GRINDING APPARATUSES," filed June 9, 1975, which issued on Aug. 31, 1976 as U.S. Pat. No. 3,977,612; and to subject matter disclosed and claimed in the Moskowitz patent application Ser. No. 585,378, entitled "GRINDING DISKS," filed June 9, 1975, which issued on Aug. 31, 1976 as U.S. Pat. No. 3,977,613.

BACKGROUND OF THE INVENTION

The invention set forth in this specification pertains to a new and improved grinding apparatus and method. More specifically it pertains to the use of material movement during grinding to promote the flow of such material to between grinding wheels.

The use of grinding wheels or disks is considered to be virtually as old as civilization itself. In a grinding apparatus in which such wheels are used an appropriate apparatus or means is used to cause relative rotation between the wheels. Such an apparatus normally employs a feed hopper for holding the material to be ground and for conveying such material to an inlet opening located in one of the wheels and leading to a space generally between the wheels. As an apparatus of this type is operated so that there is relative rotation between the wheels the movement of the wheels normally causes the movement of such material generally between opposed peripheral comminution surfaces on the wheels.

Obviously a grinding apparatus utilizing the parts indicated in the preceding can be constructed in many different ways, and can be utilized for grinding many different types of materials. In some uses of a gringing apparatus having the parts as noted problems have been encountered in feeding the material to be ground from the hopper to generally between the grinding wheels or disks. In some cases such problems are primarily the result of the material within the hopper not flowing by gravity to generally between the wheels or disks. In some cases the reverse movement of material from generally between the wheels or disks back toward the hopper caused by the operation of the wheels or disks tends to interfere with the desired movement of material toward the wheels or disks.

When a grinding apparatus as noted is constructed or operated in such a manner that such reverse movement or kickback of material being ground is encountered the character of the material kicked back may cause an additional impediment to the desired flow of the material from the hopper to generally between the grinding wheels or disks. This can be illustrated in connection with a grinding apparatus utilizing a lower grinding disk rotated at comparatively high speed relative to a stationary grinding disk having an upwardly directed opening in communication with a feed hopper. When such an apparatus is used with certain types of nuts the material kicked back through the opening generally toward the hopper on occasion will tend to be somewhat sticky or gummy as a result of being partially comminuted. This stickiness will in effect cause a further interference with the flow of the feed material to be ground generally between the wheels or disks.

As a result of these factors it is known to utilize an agitator or agitator structure within a feed hopper of a grinding apparatus as described in order to constantly agitate the material in such a hopper so as to constantly cause it to move toward the grinding wheels at a desired rate. A wide variety of such agitators have been proposed and used. It is considered undersirable in many types of grinding apparatus to utilize an agitator which is mechanically operated so as to cause agitation of the feed material because of the cost and relative complexity of a mechanically driven agitator.

Hand actuated agitators have also been proposed and used. It is considered that these are not overly acceptable because the user of a grinding apparatus in which relative movement between the grinding wheels is caused mechanically through an appropriate motor or the like normally will not be satisfied in having to constantly monitor the operation of the grinding apparatus so as to actuate a hand operated actuator as required.

SUMMARY OF THE INVENTION

The invention set forth herein is intended to provide feed agitation in a grinding apparatus of the type indicated in such a manner as to avoid the costs and related problems attendant to the use of mechanically powered feed agitation and so as to avoid the objectionable aspects of hand powered feed agitation. From this it is believed that it will be apparent that an objective of the invention is to provide a new and improved apparatus and method for feed agitation in a grinding apparatus of the type described in which material is fed from a hopper to generally between two grinding wheels or disks.

More specifically an objective of the present invention is to provide a method and apparatus as described in which the movement of the material being ground between such disks is imparted to an agitating mechanism as hereinafter described so as to promote feed from the hopper to generally between the grinding disks. A further objective of the invention is to provide an apparatus as described which may be easily and conveniently constructed at a comparatively nominal cost, which is effective for its intended purpose or utilization, and which is capable of giving prolonged, reliable performance with a minimum of maintenance. A still further objective of the invention is to provide a method as indicated which may be easily and conveniently carried out with a minimum of difficulty and which is also satisfactory for its intended utilization.

A grinding apparatus in accordance with this invention has opposed grinding wheels or disks which in turn have opposed peripheral communution surfaces, means for causing relative rotation between these wheels, an inlet opening leading to the center of one of the wheels, a hopper for conveying material to be comminuted through the opening to generally between the grinding wheels and agitating means for promoting movement of material from within said hopper through said opening to generally between said grinding wheels and includes the improvement which comprises the agitating means comprising a shaft rotatably mounted within said hopper, an agitating member extending from said shaft through at least a part of said hopper, at least a portion of said agitating member being spaced from the axis of rotation of said shaft, said agitating member being located so as to be contacted by material in the process of being comminuted which has been placed in motion as a result of the relative rotation between said grinding wheels.

In accordance with the process of this invention the relative rotation between the grinding wheels will serve to place material which has not been completely ground or comminuted by the grinding wheels in motion in such a manner that this material is placed in contact with the agitating member indicated in the preceding. The contact between this material and the agitating member serves to impart motion to the agitating member so as to cause movement of the agitating member to an extent sufficient that the movement of the agitating memeber tends to contact material being conveyed or fed to between the grinding wheel so as to promote the flow of such material to between these wheels.

BRIEF DESCRIPTION OF THE DRAWINGS

The actual nature of the present invention can be best more fully indicated by referring to the accompanying drawings in which:

FIG. 1 is a side elevational view of a presently preferred embodiment or form of an apparatus employing the invention set forth herein;

FIG. 2 is a partial cross-sectional view at an enlarged scale taken at line 2—2 of FIG. 1;

Figure 3:
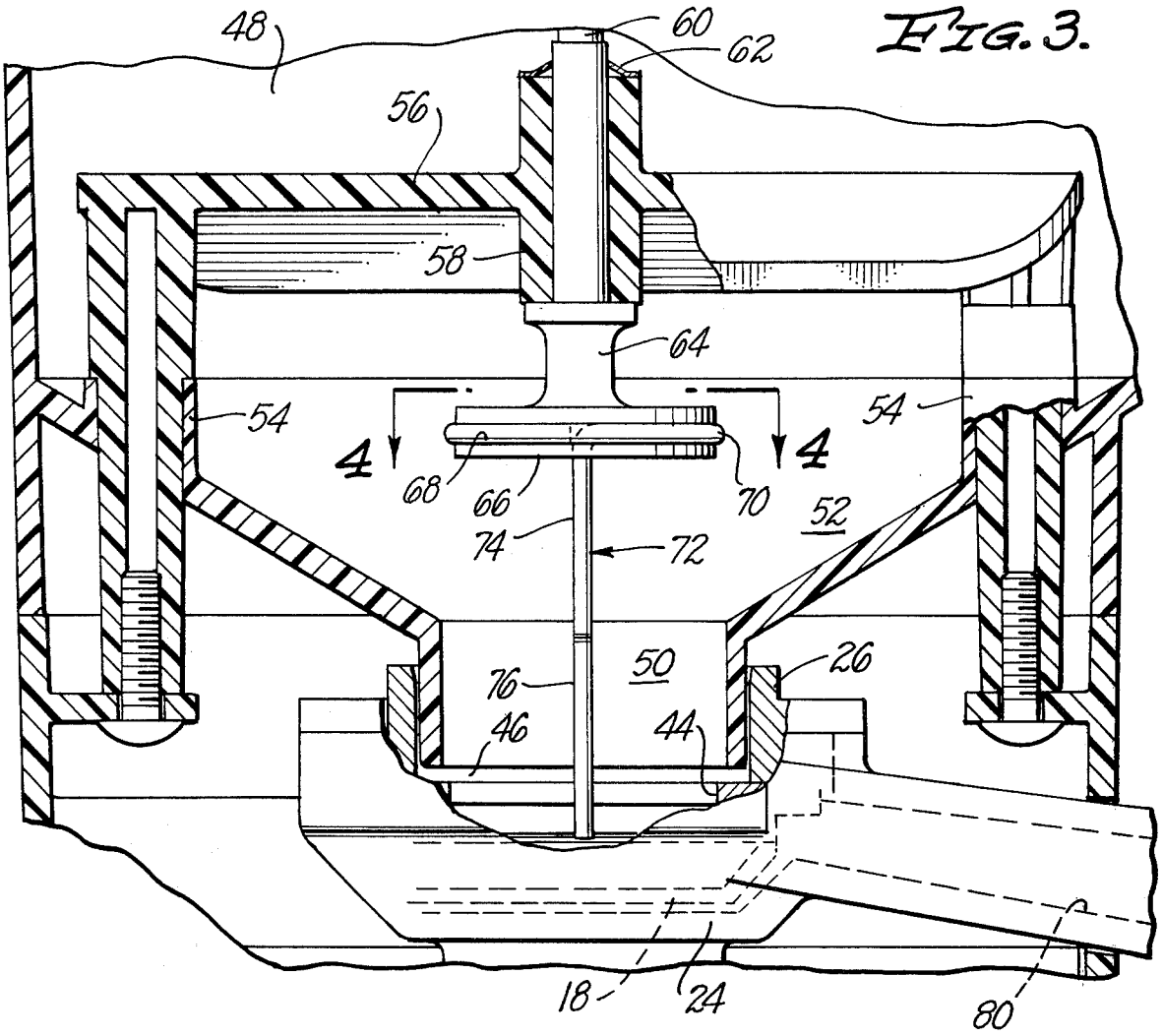
FIG. 3 is a partial cross-sectional view taken at line 3—3 of FIG. 2.
Figure 4:
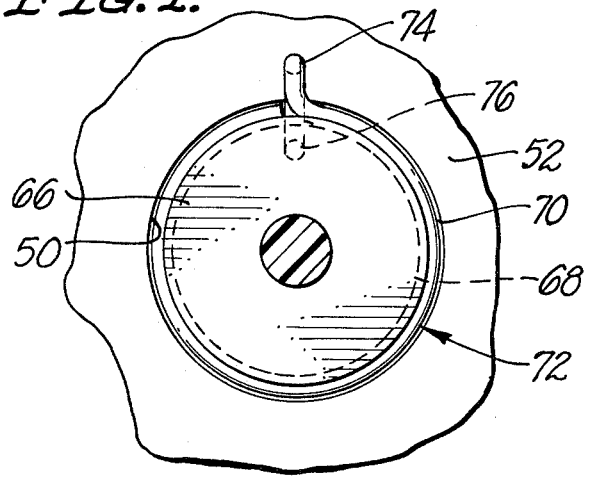
FIG. 4 is a partial cross-sectional view taken at line 4—4 of FIG. 3.
Figure 5:
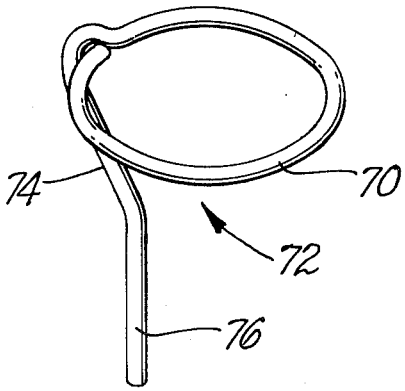
FIG. 5 is an isometric view of the agitating member indicated or illustrated in the preceding FIGS. 2 through 4.

The particular apparatus illustrated in the drawings utilizes and/or embodies the concepts as are set forth and defined in the appended claims. Those skilled in the field of the construction and design of grinding apparatus should have no difficulty in employing these concepts set forth in the claims in a wide variety of somewhat differnetly appearing and somewhat differently utilized types of grinding equipment.

DETAILED DESCRIPTION

In the drawings there is shown a grinding apparatus 10 which includes a base 12 adapted to be located upon a suitable supporting surface. Within this base 12 there is located an electric motor 14 which serves to drive a cooling fan 16 and grinding disk or wheel 18. This 14 is coupled to this wheel 18 by means of a conventional shaft 20 supported within a bearing 22. This bearing 22 forms a part of a lower housing section 24 which is supported generally upon the motor 14.

This housing section 24 is of a generally cup-like shape and in turn is connected to an upper housing section 26 by means of a hinge 28. This section 26 includes a generally plate-shaped circular lower end 30 which is adapted to be sealed with respect to the lower section 24 by means of a conventional O-ring seal 32. This lower end 30 also is rigidly secured to an upper grinding wheel or disk 34. The section 26 also includes and extended arm 36 engaged with an adjustment knob 38 supported upon a base 12.

This knob 38 is rotatable about a shaft-like extension 40 on the section 24 for the purpose of varying slightly the spacing between peripheral comminution surfaces 42 on the wheels 18 and 34. The precise construction of the knob 38 and the manner in which it engages the arm 36 in order to accomplish such adjustment forms no part of the invention set forth in this specification. Preferably the surfaces 42 are shaped in a known manner so as to facilitate grinding.

The wheel 34 is provided with a centrally located opening 44 which is in alignment with the shaft 20 and which is also in alignment with another somewhat larger diameter opening 46 in the upper section 26. A hopper 48 is mounted on the base 12 so that a cylindrical discharge chute 50 from this hopper extends into the opening 46 to adjacent to the wheel 34. This chute 50 preferably fits closely within the opening 46 so that there is little chance of material passing from the hopper 48 to generally between the wheels 18 and 34.

This hopper 48 also includes a sloping bottom 52 leading to the chute 50. Appropriate mechanical supports 54 are provided on the bottom 52 for the purpose of supporting a bridge or beam 56 generally across the hopper 48 above the chute 50. This beam 56 preferably has an inverted V-shaped cross-sectional configuration so that it will tend to deflect material onto the bottom 52 of the hopper 48. This beam 56 carries a vertically aligned bearing 58 which is located above and in alignment with the chute 50, the openings 44 and 46 and the shaft 20.

This bearing 58 is employed so as to support a shaft 60 so that this shaft 60 extends vertically and is capable of being rotated. Downward movement of the shaft 60 is prevented by the use of a conventional shaft collar 62. Displacement of the shaft 60 upwardly is prevented by a somewhat spool-like support 64 secured to the shaft 60 so as to rotate with it. This support 64 has a bottom flow control disk 66 which is located directly above and in alignment with the chute 50. This disk 66 is also provided with a peripheral groove 68 holding a ring-like end 70 of an agitating member 72.

This agitating member 72 includes a rod or finger-like central portion 74 which is shaped so as to move reasonably close to a portion of the hopper 48 adjacent to the chute 50 as the shaft 60 is turned and a rod or finger-like lower end 76 which is shaped so as to extend through the chute 50 and the openings 44 and 46 generally adjacent to the interior of the chute 50 and the interior of the opening 44 as the shaft 60 rotates. It will be realized from this that both the portion 74 and the end 76 are displaced from or off to one side of the axis of rotation of the shaft 60 and that the portion 74 and the end 76 rotate concentrically about the axis of rotation of the shafts 20 and 60.

During the use of the apparatus 10 a lid 78 is removed from the hopper 48 and material (not shown) to be ground such as, for example, peanuts, is located within the hopper 48. Preferably the lid 78 is then replaced. Such material to be ground will tend to accumulate on the bottom 52 of the hopper 48 and some of it will pass through the chute 50 so as to be located generally between the wheels 18 and 34. The beam 56 and the disk 66 will, because of their position within the hopper 48, tend to prevent the full weight of material from within this hopper 48 being applied to the wheels 18 and 34 when the hopper 48 is completely filled. This is considered desirable in minimizing the possibility of the weight of material tending to impede the motor 14 from operating so as to rotate the wheel 18.

As this motor 14 is operated the wheel 18 will, of course, be turned so that material passing into the space generally between the wheels 18 and 34 will pass out between the surfaces 42 in a comminuted state to within the interior of the housing sections 24 and 26.

From this location the material will normally be discharged through a chute 80 in the section 24 to an appropriate receptacle 82 which may be located on the base 12.

As material is comminuted in this manner contact between the material passing downwardly from the hopper 48 with the wheel 18 will tend to cause a certain amount of this material to be propelled or kicked back generally toward the hopper 48. This is particularly the case when the wheel 18 and disk 34 includes inwardly projecting projections 84 which are located so as to lead generally toward the surface 42 of this wheel 18. The use of specially formed projections corresponding to the projections 84 is considered to be especially advisable in efficient comminution or grinding of many materials such as nuts.

When such projection 84 are used they also have the disadvantage of tending to promote or cause material to be thrown or kicked back through the openings 44 and 46 into the chute 50 and to some extent into the hopper 48. Material which is thrown back in this manner tends to impede the flow of material generally in between the wheels 18 and 34. Further, the material which may be thrown or kicked back in this manner may be of a somewhat sticky or gummy character as a result of being to at least a degree comminuted. When the material flowing back is of such a character the nature of the thrown back material tends to significantly impede the desired flow of material to be ground through the hopper 48.

With the present invention this kick back of material is used so as to actually promote the flow of material from the hopper 48. As particles are thrown back toward the hopper 48 in the manner noted some such particles will contact the portion 74 and the end 76 of the agitating member 72. By virtue of the orientation of these portions of the agitating member 72 the force of the material hitting against it will tend to cause the agitating member 72 to rotate at a relatively slow, somewhat irregular speed.

This in turn will cause the agitating member 72 to exercise a wiping action within the chute 50, the bottom 52 and the opening 44, which will tend to promote the flow of material generally between the wheels 18 and 34. This motion of the agitating member 72 will also tend to wipe surfaces which are adjacent to this agitating member 72 free from any accumulation of material, such as accumulations of partially comminuted, relatively sticky or gummy material. The movement of materials to be ground downwardly from within the interior of the hopper 48 will also tend to remove accumulations from the agitating member 72. Further, the shape of the disk 66 will tend to deflect back toward the grinding wheels 18 and 34 any material thrown or kicked back as described.

Normally the action achieved in this manner will be adequate to impart a somewhat non-uniform movement to the agitating member 72 to promote relatively uniform flow of material being fed from the hopper 48. In case for some reason or another this action is not adequate for its intended purpose it is considered advisable to place a small knob 86 on the shaft 60 in a position in which it extends through an opening 88 in the lid 78. In case it is ever necessary to promote desired feed flow the knob 86 may be manually turned.

The invention set forth is considered to be quite desirable in that it relates to a convenient, simple, effective way of promoting material or feed movement or flow to between grinding disks without utilizing either a mechanically powered or a hand powered agitator. As pointed out in the preceding discussion both of such types of agitation are believed to be undesirable.

I claim:

1. A grinding apparatus which has opposed grinding wheels provided with opposed peripheral comminution surfaces, motor means for causing relative rotation between said wheels, an inlet opening leading through the center of one of said wheels, a hopper for conveying material through said opening to between said wheels and agitating means for promoting flow of material from within said hopper to between said wheels in which the improvement comprises;

said agitating means including a shaft rotatably mounted on said hopper, an agitating member attached to and extending from said shaft through at least a portion of said hopper, at least a portion of said agitating means being spaced from the axis of rotation of said shaft, said agitating means being spaced from the interior of said hopper and being capable of being rotated about the axis of rotation of said shaft, said agitating means being further located where it will be contacted by material in the process of being comminuted which has been placed in motion as the result of the relative rotation between said grinding wheels so as to be rotated as a result of contact by such material.

2. An apparatus as claimed in claim 1 wherein:

the axis of rotation of said wheels and said shaft are coincident with one another and said shaft is vertically oriented, said opening is in the uppermost of said wheels and is symmetrical about the axis of rotation of said wheels, and said hopper is located above the uppermost of said wheels.

3. An apparatus as claimed in claim 2 wherein:

the uppermost of said wheels is secured against rotation, and said motor means rotates the lowermost of said wheels.

4. An apparatus as claimed in claim 3 wherein:

said lowermost of said wheels includes projection means located on said lowermost of said wheels and adjacent to said inlet opening, said projection means being capable of causing the back-flow of material flowing through said opening to generally between said wheels.

5. An apparatus as claimed in claim 4 wherein:

said hopper includes bridge means located within said hopper so as to be spaced from and above said inlet opening and a bearing located on said bridge, said shaft being mounted on said bearing.

6. An apparatus as claimed in claim 5 including:

a disk rotatably mounted on said shaft above and spaced from said inlet opening, and wherein:

said agitating means is mounted on said disk and includes a rod-shaped portion extending downwardly from said disk through a part of said hopper and into said inlet opening.

7. An apparatus as claimed in claim 6 including:

auxillary mechanical means for rotating said agitating means when contact of material being comminuted with said agitating means is insufficient to cause rotation of said agitating means.

8. An apparatus as claimed in claim 1 including:

auxiliary mechanical means for use in rotating said agitating means when contact of material being comminuted with said agitating means is insufficient to cause rotation of said agitating means.

9. An apparatus as claimed in claim 1 wherein:

the axis of rotation of said wheels and said shaft are coincident with one another and extend vertically, said inlet opening is in the uppermost of said wheels and is symmetrical about the axis of rotation of said wheels, said hopper is located above the uppermost wheels, a portion of said agitating means extends downwardly from within said hopper toward said inlet opening, said portion being spaced from said axes of rotation, said portion being located where it can be contacted by material thrown back toward said hopper toward said inlet opening as a result of the relative rotation between said wheels.

10. An apparatus as claimed in claim 1 including:

means on the lowermost of said wheels and generally between said wheels for causing material to be thrown back from between said wheels through said inlet opening and toward said hopper.

11. A process of agitating a material within a hopper so as to promote the flow of said material from within said hopper through an opening in a grinding wheel to generally between said wheel and another grinding wheel as there is relative rotation occurring between said wheels in which the improvement comprises:

operating said wheels so that there is some backflow of material from generally between said wheels generally away from said wheels and toward said hopper, allowing the material caused to back-flow as a result of the operation of said wheels to hit against an agitating member movably mounted in a position in which movement of said agitating member will tend to promote flow from said hopper toward said wheel, the contact of said material causeed to back-flow because of the operation of said wheels with said agitating member causing said agitating member to move to promote the flow of material from within said hopper through said opening to generally between said wheels.

12. A process as claimed in claim 11 wherein:

said agitating member is rotated as a result of being contacted by material caused to back-flow.

* * * * *